US011294321B2

(12) United States Patent
Katahira

(10) Patent No.: US 11,294,321 B2
(45) Date of Patent: Apr. 5, 2022

(54) IMAGE FORMING APPARATUS

(71) Applicant: CANON KABUSHIKI KAISHA, Tokyo (JP)

(72) Inventor: Ko Katahira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/332,844

(22) Filed: May 27, 2021

(65) Prior Publication Data

US 2021/0373479 A1 Dec. 2, 2021

(30) Foreign Application Priority Data

May 29, 2020 (JP) ..... JP2020-094048

(51) Int. Cl.
*G03G 15/00* (2006.01)
*G03G 21/16* (2006.01)

(52) U.S. Cl.
CPC ..... *G03G 15/80* (2013.01); *G03G 21/1619* (2013.01); *G03G 2221/166* (2013.01)

(58) Field of Classification Search
CPC ..... G03G 15/80; G03G 21/1619; G03G 2221/166
See application file for complete search history.

(56) References Cited

U.S. PATENT DOCUMENTS

| | | | | |
|---|---|---|---|---|
| 5,950,046 | A | 9/1999 | Goto | 399/110 |
| 2013/0236210 | A1* | 9/2013 | Takabayashi | G03G 15/80 399/107 |
| 2015/0063864 | A1* | 3/2015 | Kitan | G03G 21/1619 399/107 |
| 2016/0109848 | A1* | 4/2016 | Ohata | G03G 21/1619 399/107 |

FOREIGN PATENT DOCUMENTS

| | | |
|---|---|---|
| JP | H08-339108 | 12/1996 |
| JP | H10-239932 | 9/1998 |
| JP | H11-65195 | 3/1999 |
| JP | 2003-069765 | 3/2003 |
| JP | 2011-008300 | 1/2011 |

* cited by examiner

*Primary Examiner* — Sandra Brase
(74) *Attorney, Agent, or Firm* — Venable LLP

(57) ABSTRACT

An image forming apparatus includes an image forming portion and a post-processing portion, a first frame, a second frame and a connection member. The first frame includes a first section for supporting a photosensitive member and a second section bent from a bottom end of the first section. The second frame, to which an electronic circuit board is attached, supported by the second section of the first frame without being fixed to the first section of the first frame. The connection member is connected with the second frame and a third frame which is a frame of the post-processing portion.

14 Claims, 8 Drawing Sheets

IMAGE FORMING APPARATUS

FIELD OF THE INVENTION AND RELATED ART

The present invention relates to an image forming apparatus, such as an electrophotographic copying machine and a laser printer, which forms an image on a sheet of recording medium with the use of an electrophotographic process.

There has been known in the field of an image forming apparatus, a structural arrangement that places an image reading section for reading the image of an original, a post-processing section for binding sheets of recording medium after the formation of an image on the sheets, on the top side of the image forming section for forming an image. In the case of this structural arrangement, the frame of the image forming section supports the image reading section and post-processing section.

Further, there has been proposed to provide an image forming apparatus with supporting posts for supporting an image reading section, a boxy portion to which an electronic circuit board is attached, connectors which keep the supporting posts in connection with the boxy frame, side plates which make up a part of the frame of the image forming section, and to which supporting posts, boxy frame, and connectors, which make up parts of the frame of the image forming section, and an electronic circuit board, are attached (patent document 1: Japanese Laid-open Patent Application No. 2011-008300), In the case of this structural arrangement, the boxy frame and supporting posts are integrated with each other to support the image reading section. Thus, the load generated by the weight of the image reading section itself is distributed between the side plates and boxy frame, making it possible to more effectively prevent the side plates from being deformed, compared to the structural arrangement in which the connectors are attached to only the side plates.

In the case of the structural arrangement disclosed in Japanese Laid-open Patent Application No. 2011-008300, the side plates have the first section for supporting a photosensitive member, and the second section which extends from the bottom of the first section at a preset angle. The boxy frame is in connection to the first section of the side plate, but, not to the second section. In the case of such a structural arrangement that the supporting post is connected to the boxy frame, but, not to the second section of the side plate, even though external forces, such as those that result from the impacts which an image forming apparatus is subjected during its shipment or in the like situation, are transmitted to the first section of the side plate through the boxy frame, they are not dispersed into the second section of the side plate. Therefore, it is possible for the first section of the side plate to be deformed by the transmitted external forces, which in turn disturbs the image forming apparatus in the positional relationship between its photosensitive member and other members, which in turn negatively affects an image forming apparatus in terms of image quality.

SUMMARY OF THE INVENTION

Thus, the primary object of the present invention, which relates to an image forming apparatus having a post-processing section and an image reading section on the top side of its image forming section, is to provide an image forming apparatus, the frame of which for supporting its photosensitive member does not deform.

According to an aspect of the present invention, there is provided an image forming apparatus provided with an image forming portion configured to form an image by transferring a toner image formed on a surface of a photosensitive member to a sheet, and a post-processing portion, provided on a top side of said image forming portion, configured to perform a binding operation to the sheet on which the image is formed by said image forming portion, said image forming apparatus comprising: a first frame including a first section configured to support said photosensitive member and a second section bent from a bottom end of said first section; a second frame, to which an electronic circuit board is attached, supported by said second section of said first frame without being fixed to said first section of said first frame; and a connection member configured to be connected with said second frame and a third frame which is a frame of said post-processing portion.

Further features of the present invention will become apparent from the following description of exemplary embodiments (with reference to the attached drawings).

DESCRIPTION OF THE EMBODIMENTS

Embodiment 1

<Image Forming Apparatus>

Hereinafter, the present invention is described with reference to a few of the preferred embodiments of the present invention, along with appended drawings. To begin with, the overall structure of the image forming apparatus in the first embodiment of the present invention is described along with its image forming operation. By the way, the measurements, materials, shapes of the structural components of the image forming apparatus, which will be described next, and the positional relationship among the components, are not intended to limit the present invention in scope, unless specifically noted.

Figure 1:
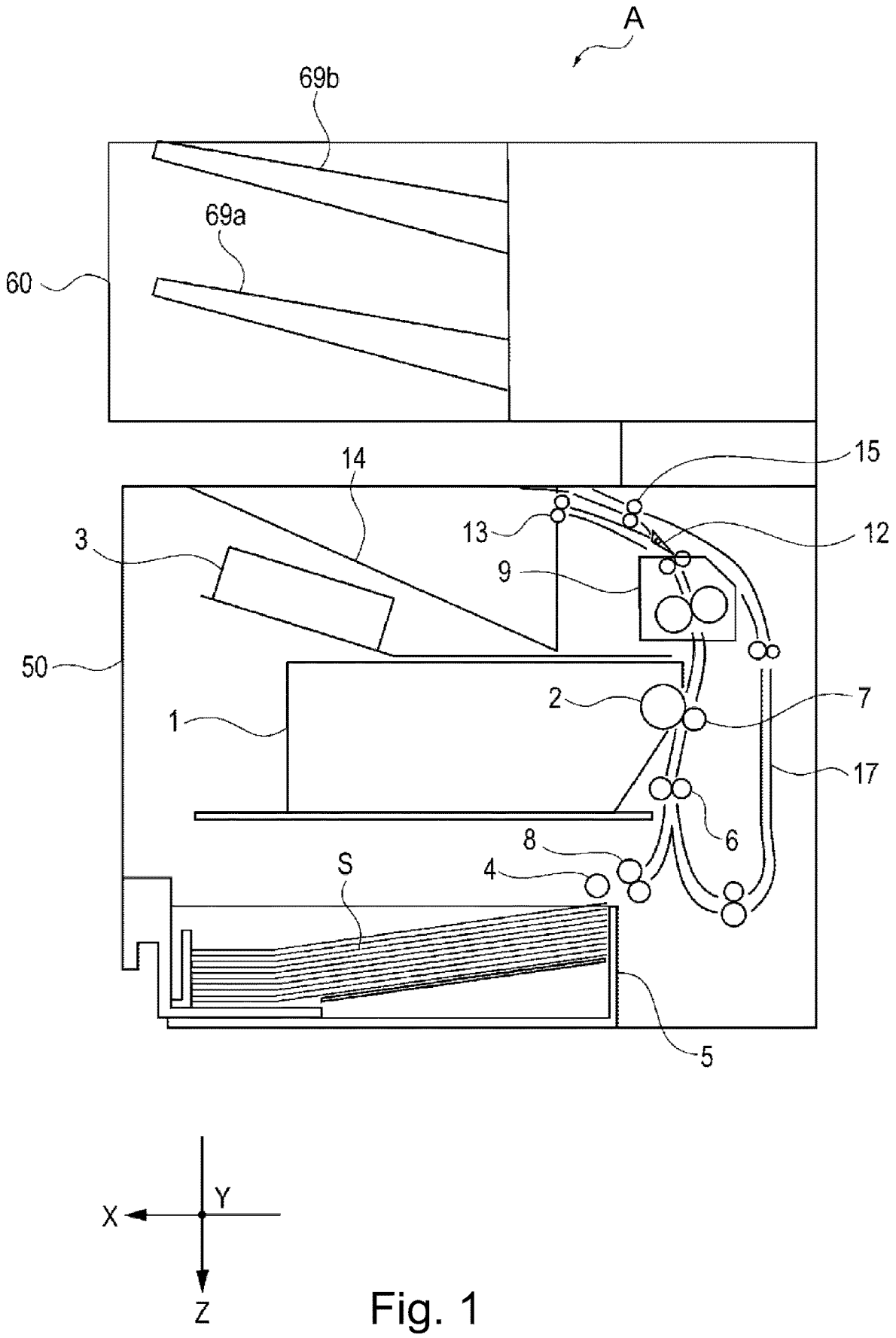
FIG. 1 is a schematic sectional view of the image forming apparatus in the first embodiment of the present invention.

FIG. 1 is a schematic sectional view of the image forming apparatus A. As shown in FIG. 1, the image forming apparatus A has: an image forming section 50 for forming an image on a sheet S of recording medium; and a post-processing section 60, which are placed on the top side of the image forming section 50. The post-processing section 60 processes sheets S of recording medium I in a preset manner (which will be described later) after the formation of an image on the sheets S by the image forming section 50.

The image forming section 50 has various image forming members for forming a toner image on a sheet S of recording medium, more specifically, a process cartridge 1 which is an integral combination of a photosensitive drum 2, a charge roller (unshown), and a developing apparatus (unshown), a laser scanner unit 3, and a transfer roller 7. Further, it has a fixing apparatus 9 for fixing the unfixed toner image on a sheet S, to the sheet S, a sheet cassette 5, in which sheets S are stored, etc.

The steps through which an image is formed by the image forming apparatus A is as follows: First, the unshown control section receives an image formation job signal. As it receives the signal, it begins to rotate a pickup roller 4 and a feed roller 8, to send the sheets S in the sheet cassette 5, to a pair of registration rollers 6, which releases each sheet S with preset timing to send the sheet S to the transferring section which is formed by the photosensitive drum 2 (photosensitive member) and a transfer roller 7.

In the process cartridge 1, voltage is applied to the charge roller (unshown). Consequently, the peripheral surface of the photosensitive drum 2, which is in contact with the charge roller, is charged by the charge roller. Then, the laser scanner unit 3 sweeps (scans) the charged peripheral surface of the photosensitive drum 2, with a beam of laser light which it emits while modulating the beam with the data of an image to be formed. Thus, the points of the peripheral surface of the photosensitive drum 2, which were exposed to the beam of laser light, reduce in potential level, forming an electrostatic latent image which reflects the data of the image to be formed. Then, the developing apparatus (unshown) adheres toner to the electrostatic latent image formed on the photosensitive drum 2. As a result, a toner image is formed on the peripheral surface of the photosensitive drum 2.

Next, the toner image on the photosensitive drum 2 is sent to a transferring section by the rotation of the photosensitive drum 2. In the transferring section, positive voltage is applied to the transfer roller 7. Thus, the toner image on the photosensitive drum 2 is transferred onto the sheet S. After the transfer of the toner image onto the sheet S, the sheet S is heated and pressed in a fixing apparatus 9. Consequently, the toner image becomes fixed to the sheet S.

Next, in a case where a user has not set the image forming apparatus A to process a sheet S (sheets S) with the use of the post-processing section 60, as the sheet S comes out of the fixing apparatus 9, the sheet S is discharged into a delivery section 14 by a pair of discharge rollers 13. In comparison, in a case where a user has set the image forming apparatus A to process the sheet S (sheets S) with the use of the post-processing section 60, as the sheet S comes out of the fixing apparatus 9, it is conveyed to the post-processing section 60. Thereafter, the sheets S are subjected to a post-processing operation, for example, an operation (a binding operation) to bundle a preset number of sheets S, a binding operation to bind the sheets S into a bundle by a stapler, etc. and an operation (a punching operation) to punch hole (holes) through the sheet S (sheets S) with the use of a hole puncher. Then, the sheet S (sheets S) is discharged into a delivery tray 69*a* or 69*b*.

By the way, in a case where an image is formed on both surfaces of a sheet S of recording medium, as the sheet S comes out of the fixing apparatus 9, it is directed by a flapper 12 toward a pair of reverse rollers 15. Then, the sheet S is turned over by the pair of reverse rollers 15, which puts the sheet S through a switchback sequence. Then, it is conveyed to the pair of registration rollers 6 for the second time through a two-sided image formation sheet passage 17. Then, an image is formed in the back surface (second surface) of the sheet S in the same manner as an image was formed on the top surface (first surface) of the sheet S.

<Structural Arrangement for Supporting Post-Processing Section>

Next, the structural arrangement for supporting the post-processing section 60 is described.

Figure 2:
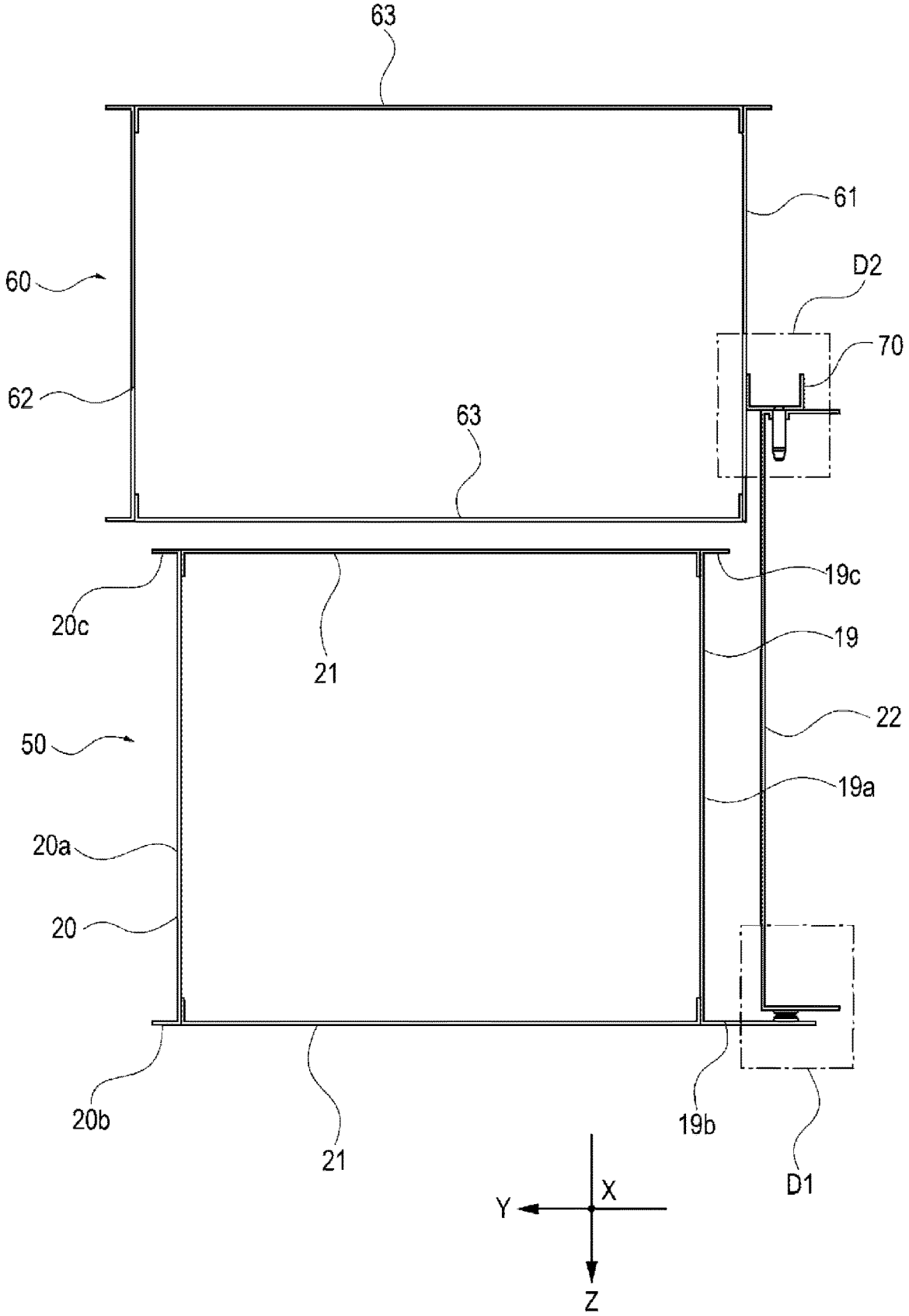
FIG. 2 is a schematic drawing of the frame of the image forming apparatus in the first embodiment; it shows the structure of the frame.
Figure 3:
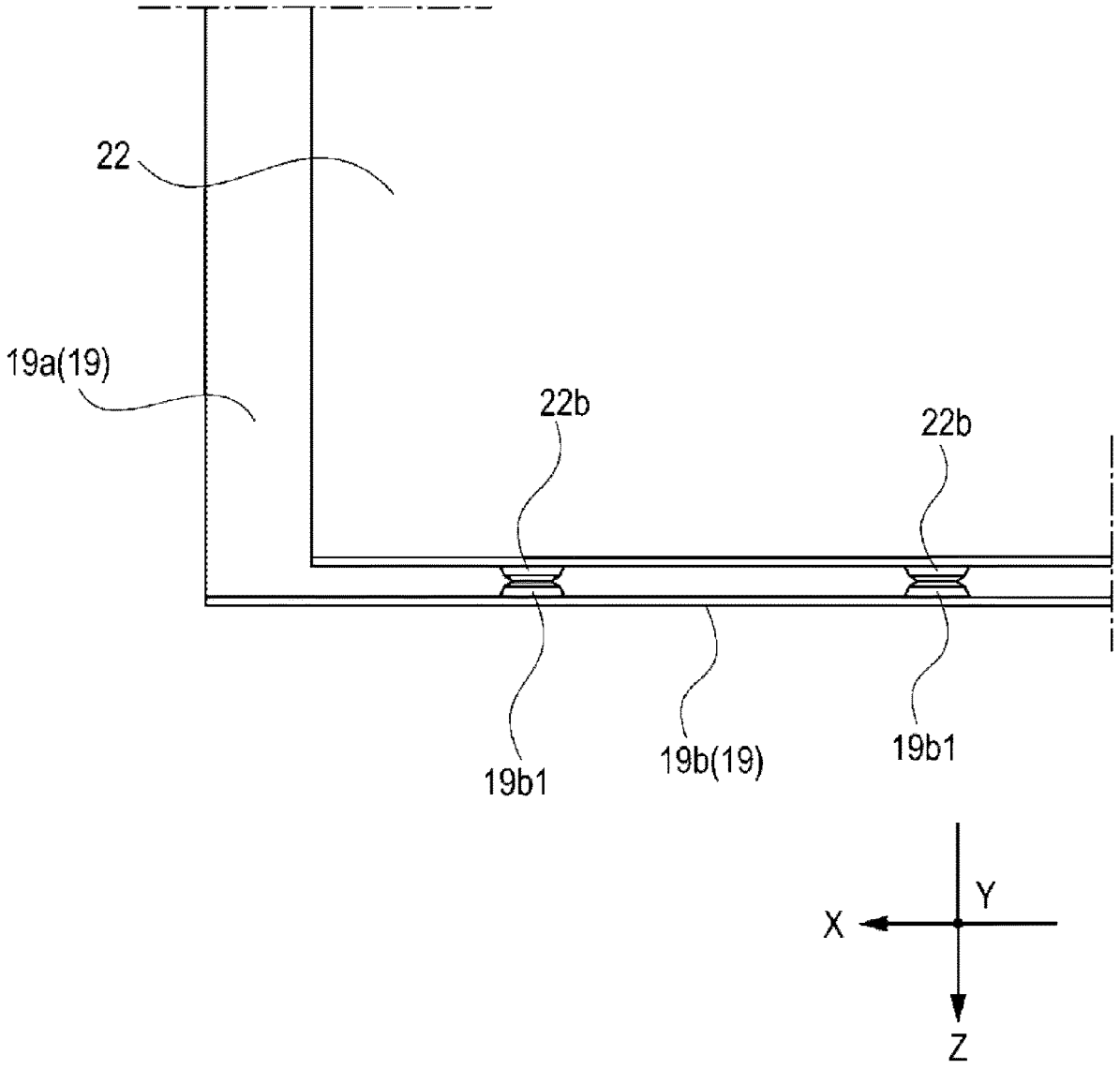
FIG. 3 is a schematic drawing of an area D1 of the frame of the image forming apparatus in the first embodiment, as seen from the direction indicated by an arrow mark Y.
Figure 4:
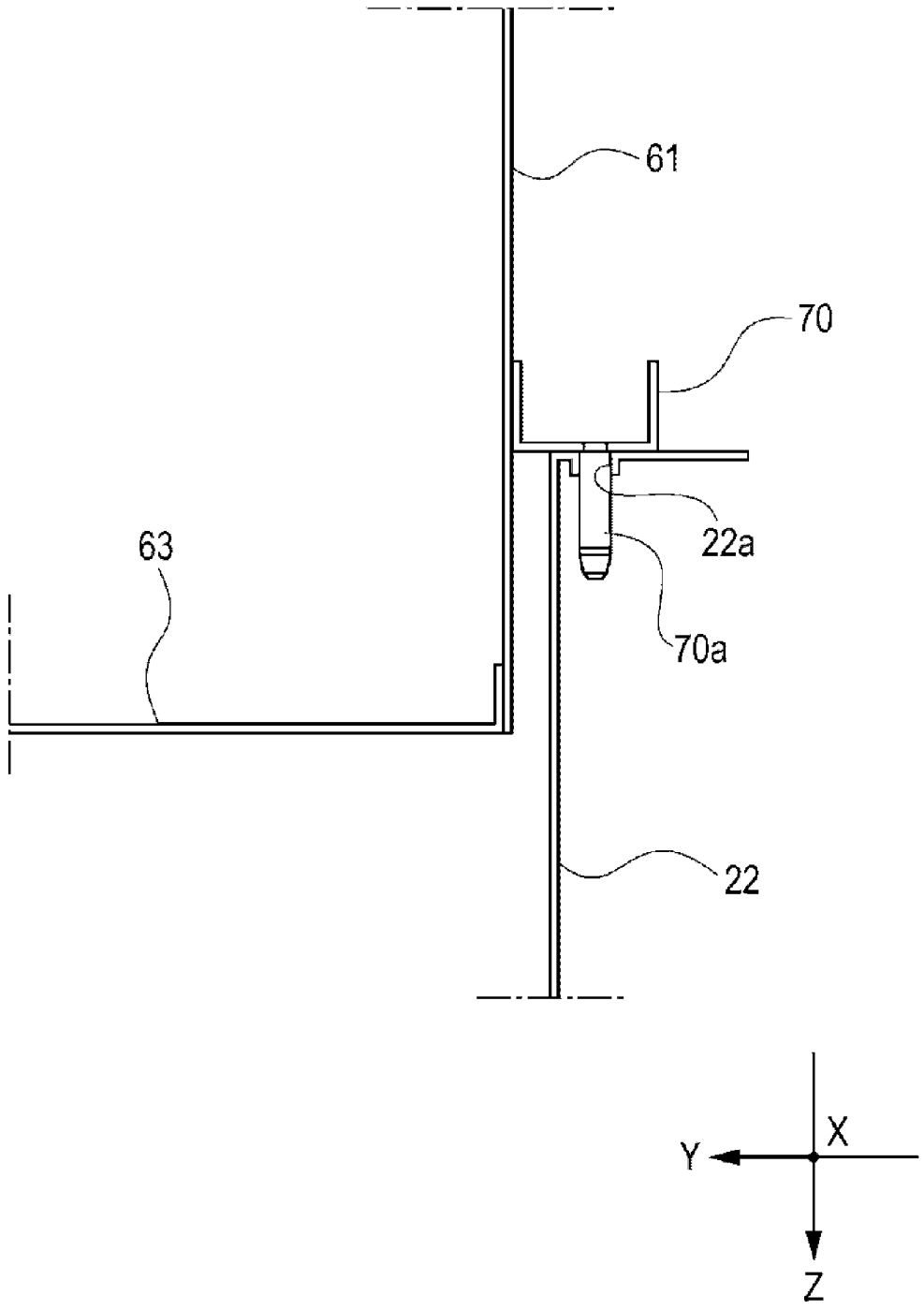
FIG. 4 is an enlarged view of an area D2 of the frame of the image forming apparatus in the first embodiment.

FIG. 2 is a schematic drawing of the frame of the image forming apparatus A in this embodiment. It is for describing the structure of the frame. FIG. 3 is a drawing of an area D1 shown in FIG. 2, as seen from the direction indicated by an arrow mark Y. FIG. 4 is an enlarged view of an area D2 in FIG. 2.

Referring to FIG. 2, the frame of the image forming section 50 of the image forming apparatus A is formed of metallic plate. It has the right plate 19 (first sub-frame) and the left plate 20 (fourth sub-frame). The right and left plates 19 and 20 are positioned in a manner to oppose each other in terms of the direction parallel to the rotational axis of the photosensitive drum 2 (direction indicated by arrow mark Y). The right plate 19 has the first, second, and third sections 19*a*, 19*b*, and 19*c*, respectively. The first section 19*a* extends in the vertical direction. The second section 19*b* is bent from the bottom end of the first section 19*a* in a crossing direction (horizontal direction), and bears the force from the load bearing surface. The third section 19*c* is bent from the top end of the first section 19*a*, in parallel to the second section 19*b*. Further, the left plate 20 has the first, second, and third sections 20*a*, 20*b*, and 20*c*, respectively. The first section 20*a* vertically extends. It opposes the first section 19*a* of the right plate 19. The second section 20*b* is bent from the bottom end of the first section 20*a* in a crossing direction (horizontal direction). The third section 20*c* which is bent from the top end of the first section 20*a* in a crossing direction (horizontal direction), in parallel to the second section 20*b*. The first section 19*a* of the right plate 19, and the first section 20*a* of the left plate 20, are provided with a guide rail (unshown) for guiding the movement of the process cartridge 1, and a berth (unshown) for the process cartridge 1. As described above, the process cartridge 1 is supported by the first section 19*a* of the right plate 19, and the first section 20*a* of the left plate 20, and so are the photosensitive drum 2 and charge roller (unshown).

The frame of the image forming section 50 of the image forming apparatus A is formed of metallic plate. It has multiple middle stays 21 and a circuit board holder 22 (second sub-frame). The middle stays 21 connect the right plate 19 to the left plate 20. The circuit board holder 22 is positioned on the opposite side from the left plate 20. The circuit board holder 22 is not attached to the first section 19*a* of the right plate 19. The bottom end of the circuit board holder 22 is fixed to the second section 19*b* of the right plate 19 with small screws. To the circuit board holder 22, such electronic circuit board as a power source circuit board for converting the voltage from the commercial power source into such voltage that can be used by various devices of the image forming apparatus A, an engine control circuit board for controlling the driving of the image forming section 50, a controller circuit board for processing image formation data, etc., which are not shown, are attached.

Referring to FIG. 3, the second section 19*b* of the right plate 19 is provided with multiple inward protrusions (drawing shape portions) 19*b*1, which are positioned with preset intervals. The inward protrusions 19*b* are formed by drawing (pressing). Further, the bottom portion of the circuit board holder 22 are provided with multiple outward protrusions 22*b*, which are formed by drawing (pressing). The outward protrusions (drawing shape portions) 22*b* are positioned so that a preset interval is provided between adjacent two protrusions 22*b*. Further, they are positioned to oppose the inward protrusions 19*b*1 of the right plate 19, one for one. They come into contact with the inward protrusions 19*b*1 of the right plate 19, one for one. These protrusions 19*b*1 and 22*b* can function as markers for aligning the second section 19*b* of the right plate 19 with the circuit board holder 22. Therefore, they can improve the image forming apparatus A in the efficiency with which the image forming apparatus A can be assembled. Further, even if the measurement of the circuit board holder 22 in terms of the direction indicated by an arrow mark Z is different from specifications due to production tolerance or the like, the second section 19*b* of the right plate 19, and the circuit board holder 22, can be easily placed in contact with each other. By the way, even if the protrusions 19*b*1 and 22*b* are replaced with such protrusions that are U-shaped in cross section, or ordinary protrusions, effects similar to those described above can be obtained.

Further, the frame (third sub-frame) of the post-processing section 60 of the image forming apparatus A has the right and left plates 61 and 62 which oppose each other, and multiple middle stays 63 which connect the right plate 61 to the left plate 62. The right plate 61, left plate 62, and middle stays 63 are formed of metallic plate.

Moreover, the image forming apparatus A has a connector (connection member) 70 which connects the post-processing section 60 to the circuit board holder 22, which connects the frame of the post-processing section 60 to the frame of the image forming section 50. This connector 70 is formed of metallic plate. It is solidly attached to the post-processing section 60 and circuit board holder 22 with small screws.

Next, referring to FIG. 4, the connector 70 has a positioning pin 70*a* (engaging portion). Further, the top plate of the circuit board holder 22 is provided with a positioning hole 22*a* (portion to be engaged), into which the positioning pin 70*a* is inserted. As the positioning pin 70*a* is inserted into the positioning hole 22*a*, the connector 70 and the circuit board holder 22 are accurately positioned relative to each other. By the way, the image forming apparatus A may be structured so that the circuit board holder 22 is provided with a positioning pin, and the right plate 61 is provided with a positioning hole.

As described above, in this embodiment, the circuit board holder 22 is solidly attached to the second section 19*b* of the right plate 19. Therefore, as the post-processing section 60 is subjected to large external force due to the shocks to which the image forming apparatus A is subjected during its shipment, the large external force is borne by the second section 19*b* of the right plate 19, reducing the first section 19*a* of the right plate 19 in the amount by which the first section 19*a* is subjected to the external force. Further, the circuit board holder 22 is not solidly attached to the first section 19*a* of the right plate 19, which supports the photosensitive drum 2. Therefore, even if the post-processing section 60 is subjected to large external force which results from the shocks which occurs during the shipment of the image forming apparatus A, it is unlikely for the entirety of the external force to be transmitted to the first section 19*a* of the right plate 19. Therefore, it is unlikely for the first section 19*a* of the right plate 19 to be deformed by the external force to which the post-processing section 60 is subjected during the shipment of the image forming apparatus A. Therefore, it is unlikely for the image forming apparatus A to be negatively affected in the positional relationship between the photosensitive drum 2 and other components such as the laser scanner unit 3 and transfer roller 7. Therefore, it is unlikely for the image forming apparatus A to be negatively affected in image quality by the external force to which the post-processing section 60 is subjected during the shipment of the image forming apparatus A.

Embodiment 2

Next, the image forming apparatus in the second embodiment of the present invention is described about its structure. The portions of the image forming apparatus in this embodiment, which are similar in description to the counterparts in the first embodiment are given the same referential codes as those given to the counterparts, respectively, and are not going to be described.

Figure 5:
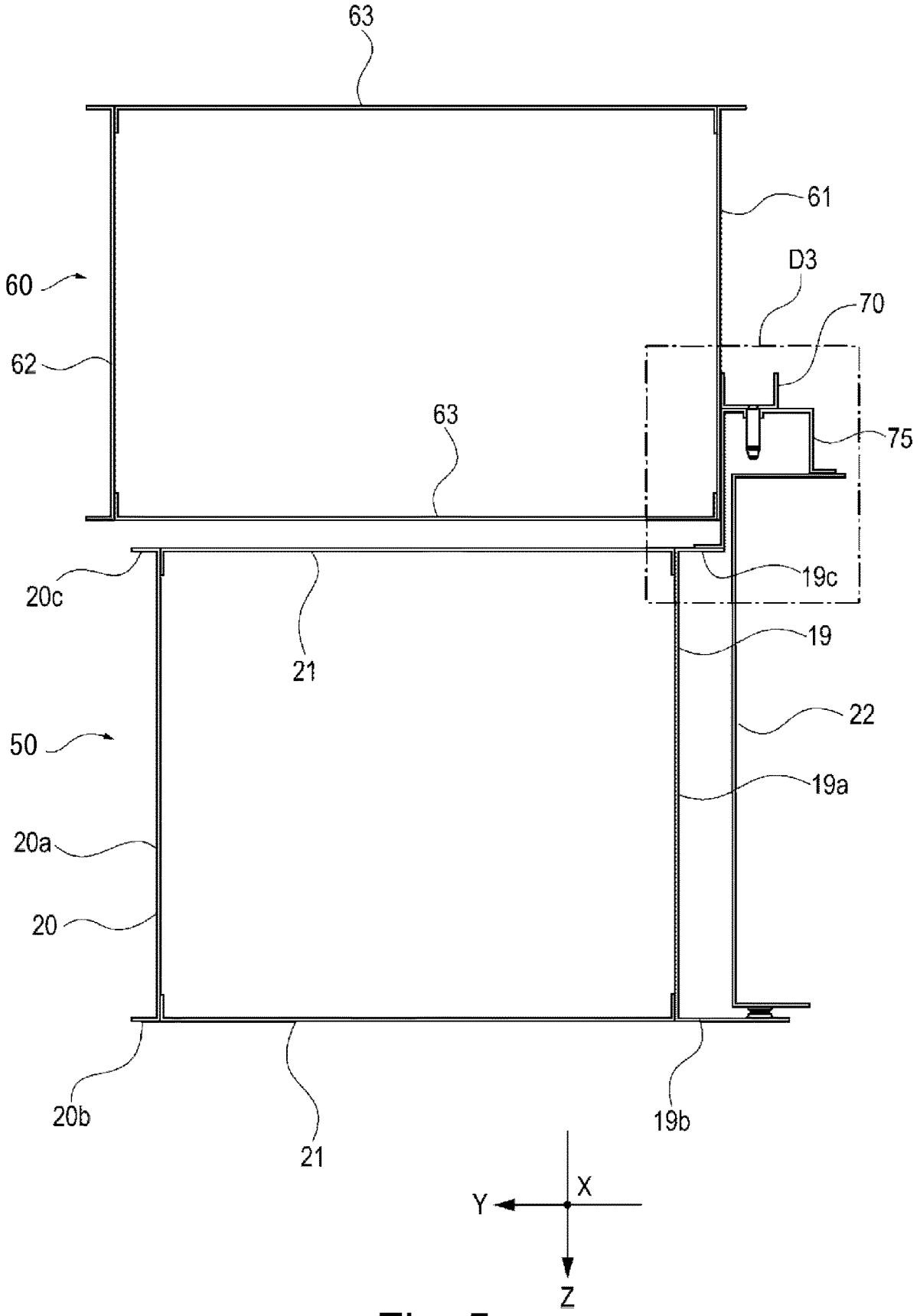
FIG. 5 is a schematic drawing of the frame of the image forming apparatus in the second embodiment of the present invention; it shows the general structure of the frame.
Figure 6:
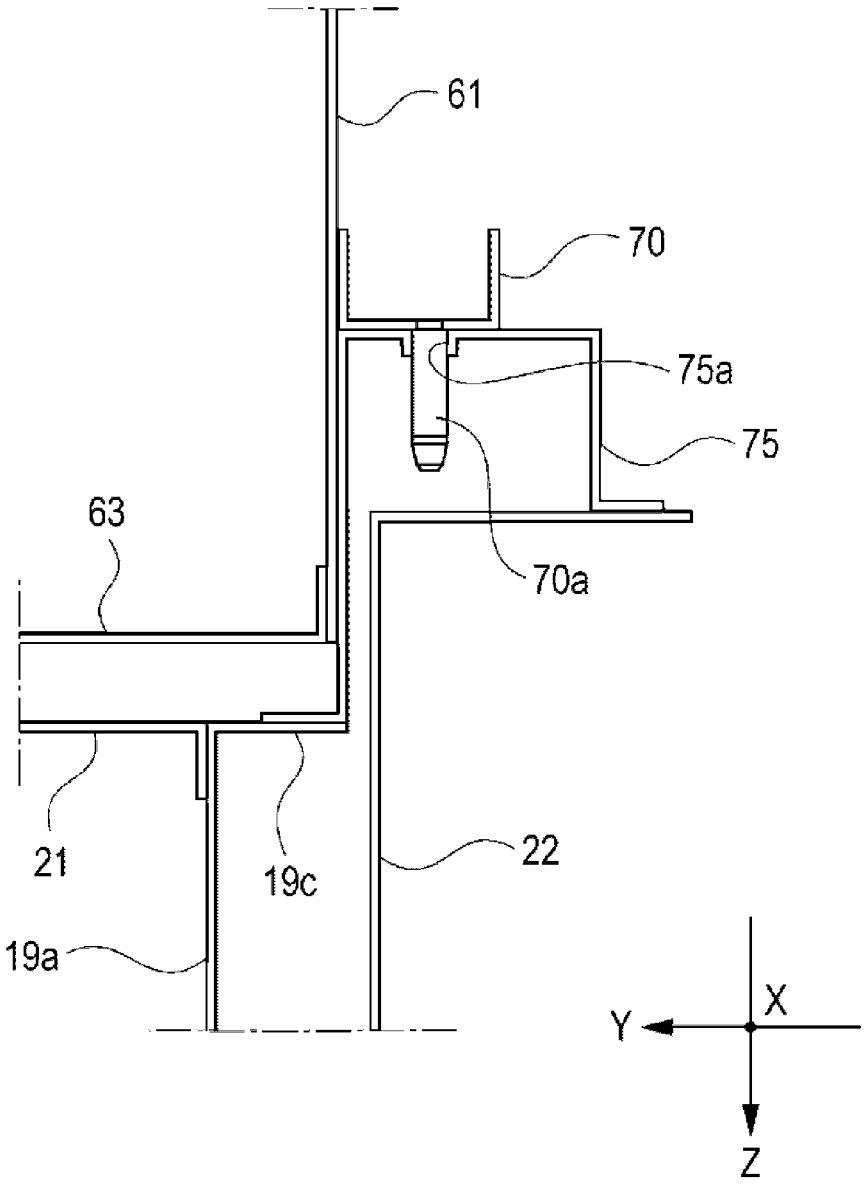
FIG. 6 is an enlarged view of an area D3 of the frame of the image forming apparatus in the second embodiment.

FIG. 5 is a schematic drawing of the frame of the image forming apparatus A in this embodiment. It shows the structure of the frame. FIG. 6 is an enlarged view of an area D3 in FIG. 5. Referring to FIGS. 5 and 6, the image forming apparatus A in this embodiment is provided with a connector 75, in addition to the connector 70. The connector 70 also is for connecting the frame of the post-processing section 60 to the frame of the image forming section 50. It is also formed of metallic plate.

The connector 75 is solidly attached to the connector 70 with unshown small screw. The top portion of the connector 75 is provided with a positioning hole 75*a*, into which the positioning pin 70*a* is inserted. As the positioning pin 70*a* is inserted into the positioning hole 75*a*, the connector 70 and connector 75 are accurately positioned relative to each other. By the way, the image forming apparatus A may be structured so that the connector 75 is provided with the positioning pin, and the connector 70 is provided with a positioning hole.

Further, the connector 75 is solidly connected to the circuit board holder 22, and the third section 19*c* of the right plate 19, with small screws. That is, the connector 75 is connected to the circuit board holder 22 which is solidly connected to the second section 19*b*, and also, the third section 19*c* of the right plate 19, instead of the first section 19*a* of the right plate 19, which supports the photosensitive drum 2. Therefore, even if the post-processing section 60 is subjected to large external force, which results from the shocks to which the image forming apparatus A is subjected during its shipment, the external force is unlikely to be transmitted to the first section 19*a* of the right plate 19, making it unlikely for the first section 19*a* to be deformed by the external force. Therefore, the image forming apparatus A is unlikely to be disturbed in the positional relationship between its photosensitive drum 2 and other components, by the external force to which the post-processing section 60 is likely to be subjected during the shipment of the image forming apparatus A. Therefore, the image forming apparatus A is unlikely to be negatively affected in terms of image quality by such external force. Further, by adjusting the connector 75 in its length in terms of the direction indicated by an arrow mark Z, it is possible to adjust the image forming apparatus A in the size of the space of its delivery section 14.

Embodiment 3

Next, the image forming apparatus in the third embodiment of the present invention is described about its structure. The portions of the image forming apparatus in this embodiment, the description of which is the same as the counterparts in the second embodiment are given the same referential codes as those given to the counterparts, and are not going to be described.

Figure 7:
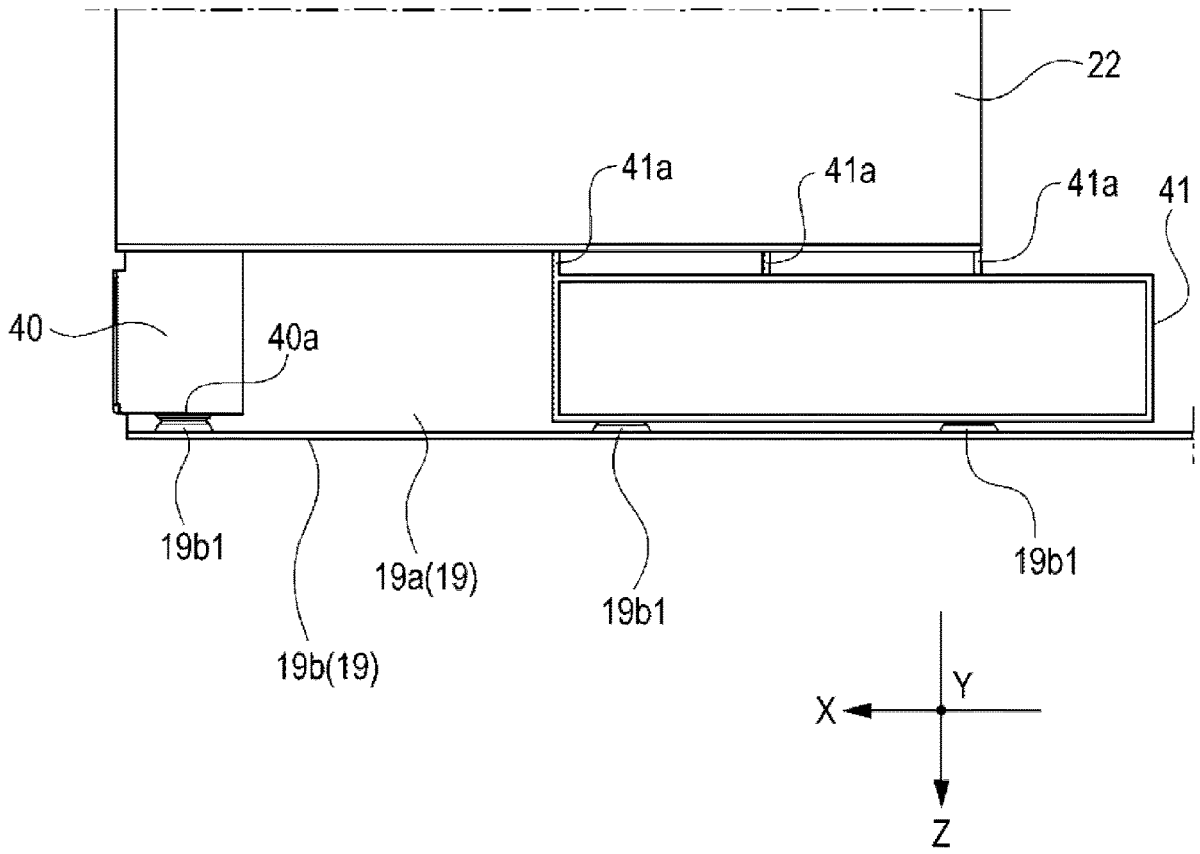
FIG. 7 is a schematic drawing of the frame of the image forming apparatus in the third embodiment of the present invention; it shows the structure of the frame.
Figure 8:
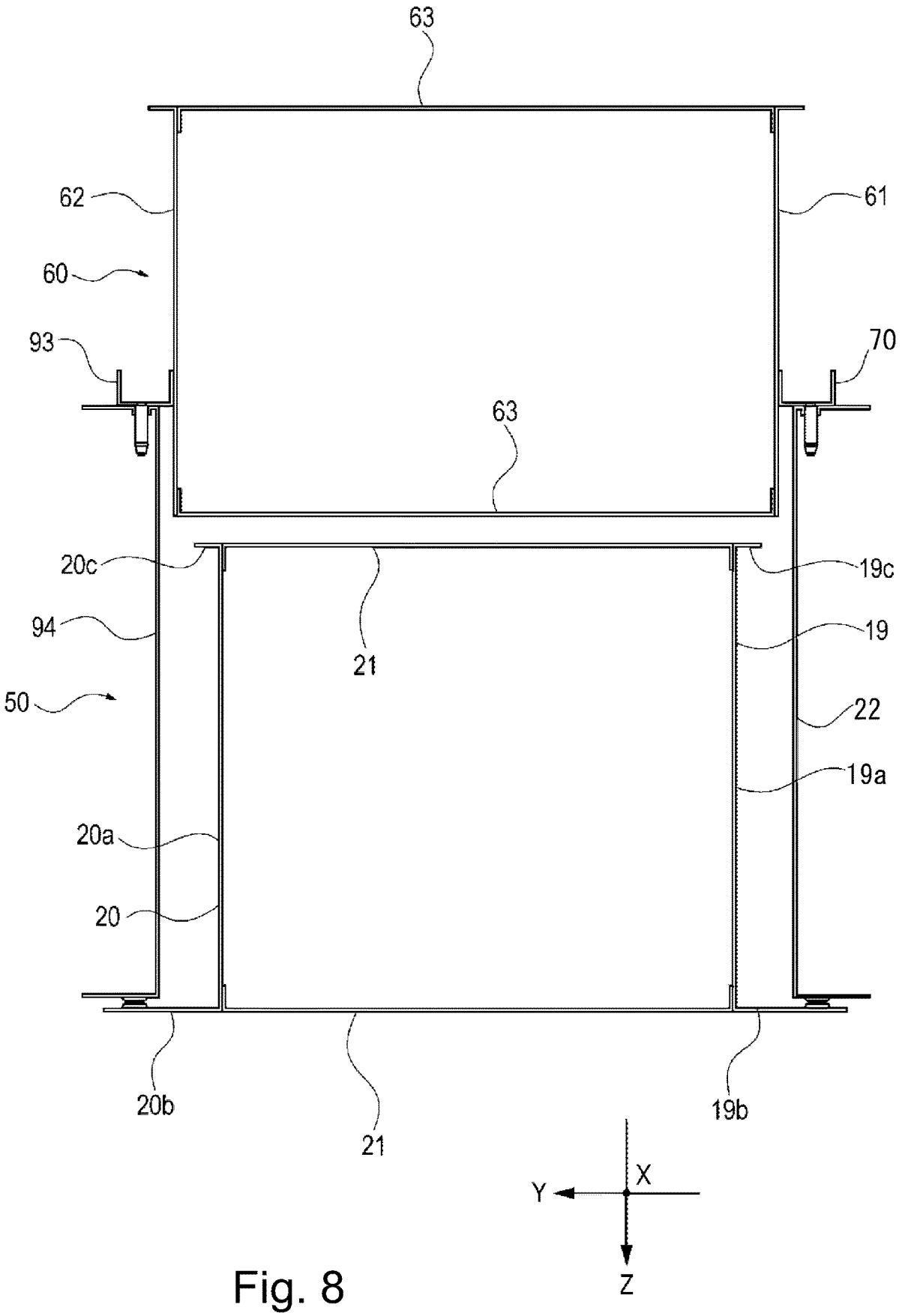
FIG. 8 is a schematic drawing of the frame of an image forming apparatus; it shows the structure of the frame.

FIG. 7 is a drawing for describing the structure of the frame of the image forming apparatus A in this embodiment. It is the portion of the image forming apparatus A in this embodiment, which is equivalent to the area D1 in FIG. 2, as seen from the direction indicated by the arrow mark Y. Referring to FIG. 7, the image forming apparatus A in this embodiment is provided with a metallic plate 40 for holding an unshown inlet for supplying the image forming apparatus A with electric power, and a handle 41 which can be grasped by a user when the user wants to lift the image forming apparatus A. Otherwise, the frame of the image forming apparatus A in this embodiment is the same in structure as the one in the first embodiment.

In terms of the vertical direction (indicated by arrow mark Z), the inlet metallic plate 40 and handle 41 are positioned under the circuit board holder 22, and above the third section 19*c* of the right plate 19. That is, they are positioned between the second section of the circuit board holder 22, and the third section 19*c* of the right plate 19. The top of the inlet metallic plate 40 (holding member) is in contact with the bottom of the circuit board holder 22, being solidly attached to the bottom of the circuit board holder 22 with unshown small screws. Further, the bottom of the inlet metallic plate 40 is solidly attached to the second section 19*b* of the right plate 19 with unshown small screws. Moreover, the bottom portion of the inlet metallic plate 40 are provided with a protrusion 40*a*, which corresponds in position to the inward protrusion 19*b*1 of the second section 19*b* of the right plate 19. The protrusion 40*a* is formed by pressing.

The handle 41 is provided multiple ribs 41*a*. The top of each rib 41*a* is solidly attached to the bottom of the circuit board holder 22 with small screws. Further, the bottom of the handle 41 is solidly attached to the second section 19*b* of the right plate 19 with small screws. Moreover, the handle 41 is positioned so that its second section rests on the protrusion 19*b*1 of the second section 19*b* of the right plate 19.

That is, the bottom of the circuit board holder 22 is indirectly fixed to the second section 19*b* of the right plate 19 through the inlet metallic plate 40 and handle 41. Therefore, even if the post-processing section 60 is subjected to large external force, which is attributable to shocks to which the image forming apparatus A is subjected during its shipment, the external force can be partially borne by the second section 19*b* of the right plate 19. Therefore, this embodiment also can prevent the problem that the entirety of the shock (external force) to which the post-processing section 60 is subjected during the shipment of the image forming apparatus A is transmitted to the first section 19*a* of the right plate 19. Therefore, it can reduce the amount by which the shock (external force) is transmitted to the first section 19*a* of the right plate 19. Therefore, it can prevent the problem that the first section 19*a* of the right plate 19 is deformed by the external force. Therefore, it can prevent the problem that as the image forming apparatus A is subjected to external force such as the shock to which it is subjected during its shipment or in the like situation disturbs the image forming apparatus A in the positional relationship between the photosensitive drum 2 and other components such as the laser scanner unit 3 and transfer roller 7. Therefore, it can prevent the problem that the image forming apparatus A is negatively affected in image quality by such external force as the one to which the image forming apparatus A is subjected during its shipment.

By the way, in the first to third embodiments, it was only to the right plate 19 that the circuit board holder 22 was solidly attached. However, these embodiments are not intended to limit the present invention is scope. For example, these embodiments may be modified so that the image forming apparatus A is provided with a circuit board holder 94, which is to be solidly attached to the second section 20*b* of the left plate 20, and a connector 93, which is to be connected to the circuit board holder 94, and the left plate 62 of the post-processing section 60. Such modification improves the image forming apparatus A in the strength of its structural arrangement for supporting the post-processing section 60.

Further, in the first to third embodiments, the post-processing section 60 of the image forming apparatus A was on the top side of the image forming section 50. These embodiments, however, are not intended to limit the present invention in scope. That is, the present invention is also applicable to an image forming apparatus (A) which has an image reading section for reading the image of an nal, instead of the post-processing section 60, and which is structured so that the image reading section is supported in the similar manner to the post-processing section 60. Such application can provide the similar effects to those obtainable by the first to third embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-094048 filed on May 29, 2020, which is hereby incorporated by reference herein in its entirety.

What is claimed is:

1. An image forming apparatus provided with an image forming portion configured to form an image by transferring a toner image formed on a surface of a photosensitive member to a sheet, and a post-processing portion, provided on a top side of said image forming portion, configured to perform a binding operation to the sheet on which the image is formed by said image forming portion, said image forming apparatus comprising:

a first frame including a first section configured to support said photosensitive member and a second section bent from a bottom end of said first section;

a second frame, to which an electronic circuit board is attached, supported by said second section of said first frame without being fixed to said first section of said first frame; and a connection member configured to be connected with said second frame and a third frame which is a frame of said post-processing portion.

2. An image forming apparatus according to claim 1, wherein said first frame includes a third section bent from the first section and different from said second section, and wherein said connection member is connected with said third section of said first frame and said second frame.

3. An image forming apparatus according to claim 1, wherein said connection member is engaged with a portion to be engaged of said second frame and provided with an engaging portion positioned to second frame.

4. An image forming apparatus according to claim 1, wherein said second section of said first frame includes a first drawing shape portion formed by drawing, and wherein said second frame includes a second drawing shape contacted to said first drawing shape portion, formed by drawing.

5. An image forming apparatus according to claim 1, further comprising a fourth frame disposed opposing said first frame with respect to a rotational axis of said photosensitive member and configured to support said photosensitive member with said first frame, wherein said second frame is disposed on a side opposite to a side on which said fourth frame is disposed to said first frame.

6. An image forming apparatus according to claim 1, wherein said second frame is fixed to said second portion of said first frame through a holding member configured to hold an inlet for supplying an electric power to said image forming apparatus.

7. An image forming apparatus according to claim 1, wherein said first frame, said second frame and third frame are formed of metallic plate.

8. An image forming apparatus provided with an image forming portion configured to form an image by transferring a toner image formed on a surface of a photosensitive member to a sheet, and an image reading portion, provided on a top side of said image forming portion, configured to read an image of an original, said image forming apparatus comprising:

a first frame including a first section configured to support said photosensitive member and a second section bent from a bottom end of said first section;

a second frame, to which an electronic circuit board is attached, supported by said second section of said first frame without being fixed to said first section of said first frame; and a connection member configured to be connected with said second frame and a third frame which is a frame of said image reading portion.

9. An image forming apparatus according to claim 8, wherein said first frame includes a third section bent from the first section and different from said second section, and wherein said connection member is connected with said third section of said first frame and said second frame.

10. An image forming apparatus according to claim 8, wherein said connection member is engaged with a portion to be engaged of said second frame and provided with an engaging portion positioned to second frame.

11. An image forming apparatus according to claim 8, wherein said second section of said first frame includes a first drawing shape portion formed by drawing, and wherein said second frame includes a second drawing shape contacted to said first drawing shape portion, formed by drawing.

12. An image forming apparatus according to claim 8, further comprising a fourth frame disposed opposing said first frame with respect to a rotational axis of said photosensitive member and configured to support said photosensitive member with said first frame, wherein said second frame is disposed on a side opposite to a side on which said fourth frame is disposed to said first frame.

13. An image forming apparatus according to claim 8, wherein said second frame is fixed to said second portion of said first frame through a holding member configured to hold an inlet for supplying an electric power to said image forming apparatus.

14. An image forming apparatus according to claim 8, wherein said first frame, said second frame and third frame are formed of metallic plate.

* * * * *